United States Patent [19]

Muschner et al.

[11] 4,257,543

[45] Mar. 24, 1981

[54] THREE-PLATE SLIDE VALVE CLOSURE FOR LIQUID MELT CONTAINERS

[75] Inventors: Udo Muschner, Tönisvorst, Fed. Rep. of Germany; Emil Schnurrenberger, Steinhausen, Switzerland

[73] Assignee: Stopinc Aktiengesellschaft, Zug, Switzerland

[21] Appl. No.: 66,463

[22] Filed: Aug. 13, 1979

[30] Foreign Application Priority Data

Aug. 19, 1978 [DE] Fed. Rep. of Germany ..... 2836434

[51] Int. Cl.[3] ..... B22D 41/08

[52] U.S. Cl. ..... 222/600; 222/561

[58] Field of Search ..... 222/561, 598, 600

[56] References Cited

U.S. PATENT DOCUMENTS

| | | | |
|---|---|---|---|
| 3,982,582 | 9/1976 | Knorr et al. | 222/600 X |
| 4,063,668 | 12/1977 | Shapland et al. | 222/600 X |

FOREIGN PATENT DOCUMENTS

| | | | |
|---|---|---|---|
| 52-30339 | 7/1977 | Japan | 222/600 |

*Primary Examiner*—David A. Scherbel

*Attorney, Agent, or Firm*—Wenderoth, Lind & Ponack

[57] ABSTRACT

A three-plate slide valve closure includes an upper stationary plate fixed beneath an outlet in a liquid melt container, a lower stationary plate positioned at a location spaced from the upper stationary plate, and a slide plate mounted between the upper and lower stationary plates for sliding movement between open and closed positions. The upper stationary plate, the slide plate and the lower stationary plate have extending therethrough first, second and third flow-through openings, respectively, which are aligned when the slide plate is in the open position. At least the upper inlet portion of the third flow-through opening, adjacent the slide plate, has a dimension in the direction of movement of the slide plate which is at least twice as great as the dimension of the second flow-through opening in such direction of movement.

7 Claims, 3 Drawing Figures

THREE-PLATE SLIDE VALVE CLOSURE FOR LIQUID MELT CONTAINERS

BACKGROUND OF THE INVENTION

The present invention relates to an improved three-plate slide valve closure for use in liquid melt containers such as steel ladles.

This type of slide valve closure is known, for example as shown in German Pat. No. 1,783,172, and includes spaced upper and lower stationary plates with a slide plate movable positioned therebetween. The three plates have therethrough flow-through openings which align with each other when the slide plate is in an open position, such that a liquid melt may be dispensed from a liquid melt container through the flow-through openings in the three plates.

Such conventional arrangements provide that the flow-through openings in the three plates are of identical cross-sections, with the exception of a slightly conically narrowed shape of the flow-through opening in the lower stationary plate. Such slide valve closure suffers from the inherent disadvantage that when the slide plate is moved to the closed position thereof, since such movement is relatively rapid, some of the liquid melt will be maintained within the volume of the opening of the slide plate and will be trapped therein. Such trapped melt will solidify and will thereafter interfere with the further use of the slide valve closure. In the worst case, such solidified portion will completely block the flow-through opening in the slide plate.

SUMMARY OF THE INVENTION

With the above discussion in mind, it is the object of the present invention to provide an improved three-plate slide valve closure for use in liquid melt containers wherein the complete emptying of any of the liquid melt within the flow-through opening the slide plate is assured.

This object is achieved in accordance with the present invention by providing that at least an inlet portion, adjacent the slide plate, of the flow-through opening extending through the lower stationary plate has a dimension in the direction of movement of the slide plate which is at least twice as great as the dimension of the flow-through opening in the slide plate in such direction of movement. Thus, the lower outlet end of the flow-through opening in the slide plate will constantly be in communication with the flow-through opening in the lower stationary plate during all positions of movement of the slide plate from and between the open and closed positions thereof. Thus, any liquid melt within the flow-through opening in the slide plate will always be emptied into the flow-through opening through the lower stationary plate and will never be trapped within the flow-through opening in the slide plate. Accordingly, none of the melt will solidify and block the flow-through opening in the slide plate.

In accordance with advantageous embodiments of the present invention, the flow-through opening in the lower stationary plate may have a uniform widened or elongated direction throughout the entire length thereof, or alternatively, only the upper inlet portion of the flow-through opening in the lower stationary plate has such widened or elongated dimension, with the lower outlet portion of the flow-through opening in the lower stationary plate being of a reduced dimension, preferably equal to the cross-section of the flow-through openings through the slide plate and the upper stationary plate.

In accordance with a further feature of the present invention there is provided a refractory outlet spout removably attached to the lower stationary plate. This spout has therethrough a flow-through opening having a cross-section corresponding to the cross-section of the lower outlet portion of the flow-through opening through the lower stationary plate. Accordingly, various commercially available refractory outlet spouts of desired ordinary cross-sectional shapes, dependent upon the configuration of the flow-through opening through the particular lower stationary plate employed, may be selectively removably attached to the lower stationary plate of the slide valve closure.

In accordance with a further feature of the present invention the flow-through opening through the lower stationary plate includes an upper end edge which is positioned to lie outwardly of the area covered by the flow-through opening through the slide plate during movement of the slide plate. Thus, in all positions of the slide plate, and specifically when the slide plate is in the closed position thereof, this upper end edge of the flow-through opening through the lower stationary plate will be spaced from the flow-through opening in the slide plate. Thus, when the slide plate is moved to the closed position, and when liquid melt within the slide plate empties into the flow-through opening in the lower stationary plate, there is no possibility of any of such liquid melt catching and being retained on such upper end edge.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
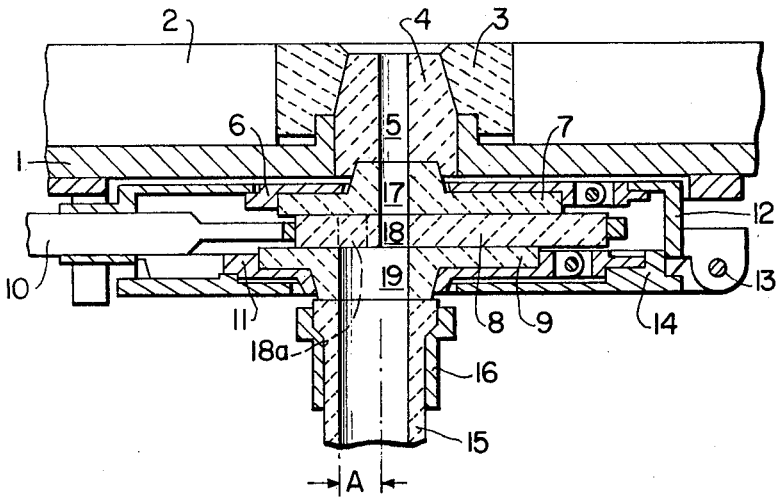
FIG. 1 is a lengthwise cross-section through a three-plate slide valve closure in accordance with the present invention and shown installed in the bottom of a metallurgical vessel.
Figure 2:
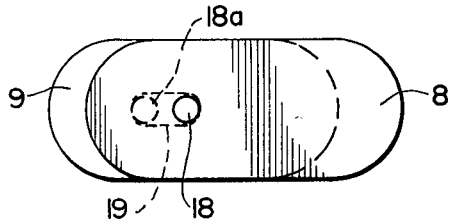
FIG. 2 is a plan view of the slide plate and lower stationary plate shown in FIG. 1.

With reference now to FIGS. 1 and 2 of the drawings, there is illustrated a portion of the bottom of a metallurgical vessel including a bottom metal jacket 1 lined with a fireproof refractory lining 2 having in an outlet region thereof a bottom brick 3. A spout brick 4 is positioned within the bottom brick 3 and has extending therethrough an outlet flow-through opening 5. Such metallurgical vessel construction is conventional, and the present invention is not intended to be specifically limited thereto, inasmuch as the three-plate slide valve closure of the present invention is equally applicable to any other type of conventional metallurgical vessel outlet structure.

The three-plate slide valve closure includes an upper stationary apertured refractory plate 7 fixedly positioned beneath the spout brick 4, a lower stationary apertured refractory plate 9 fixedly positioned at a location spaced from upper stationary plate 7, and an apertured refractory slide plate 8 mounted between upper and lower stationary plates 7 and 9, respectively, for sliding movement between open and closed positions. Upper and lower stationary plates 7 and 9 are respectively mounted in cast metal support members 6 and 11 which form part of a metal slide housing 12 which includes an openable and closeable cover 14 hinged at 13. Cover 14 is tightened in the vertical direction in a conventional manner, for example by bolts or screws (not shown) in order to tension slide plate 8 between stationary plates 7 and 9. It will be understood by those skilled in the art that such tensioning must be tight enough to prevent leakage but loose enough to permit sliding movement of slide plate 8.

Upper stationary plate 7, slide plate 8, and lower stationary plate 9 have extending therethrough first, second and third flow-through openings 17, 18 and 19, respectively. When the slide plate 8 is moved into the open position shown in FIG. 1, for example by means of a conventional hydraulic slide control unit 10, then flow-through openings 17, 18 and 19 are vertically aligned with each other and with opening 5 in spout brick 4, whereby liquid melt may be readily dispensed from the interior of the metallurgical vessel. When the control unit 10 is activated to move the slide plate into the closed position thereof, i.e. toward the left as viewed in FIG. 1, then flow-through opening 18 will be moved to a position out of alignment with openings 5 and 17, such that the further discharge of liquid melt from the interior of the metallurgical vessel is prevented. Such closed position of the flow-through opening in the slide plate is illustrated by dashed lines and by reference numeral 18*a* in the drawings.

It will be apparent that if the size of flow-through opening 19 were to be the same as that of flow-through opening 18, then when the slide plate is moved to the closed position thereof, due to the relative swiftness of such movement that portion of the liquid melt which was within second flow-through opening 18 will be trapped therein. Thereafter, such trapped portion of the liquid melt may solidify within the second flow-through opening and block such flow-through opening.

Accordingly, in accordance with the present invention at least the upper inlet portion of the third flow-through opening 19 is elongated or widened in the direction of movement of the slide plate such that the bottom outlet end of the second flow-through opening 18 is constantly in communication with the third flow-through opening 19 during all positions of movement of the slide plate.

More particularly, as shown in FIGS. 1 and 2 of the drawings, third flow-through opening 19 is an elongated, oblong opening having a dimension in the direction of movement of the slide plate which is at least twice as great as the dimension of the second flow-through opening 18 in such direction of movement. Thus, all liquid melt which is within second flow-through opening 18 during the time when the slide plate is moved to the closed position will positively be drained through the third flow-through opening 19 and will not be trapped within second flow-through opening 18.

As further shown in FIG. 1, a refractory outlet spout 15 may be removably attached, for example by means of metal sleeve 16, to lower stationary plate 9. Spout 15 has therethrough a fourth flow-through opening corresponding in cross-section to the third flow-through opening 19 in the lower stationary plate 9.

Thus, throughout the entire length of movement A of the slide plate 8 between the open and closed positions thereof, the lower or outlet end of the second flow-through opening 18 will constantly be open and in communication with the upper inlet portion of the third flow-through opening 19 in the lower stationary plate 9.

In the embodiment of FIGS. 1 and 2 of the drawings the third flow-through opening 19 is elongated throughout the entire vertical length thereof, and thus the opening through the spout 15 is similarly oblong or elongated. However, in accordance with a further embodiment of the present invention, illustrated in FIG. 3 of the drawings, only the upper inlet portion of third flow-through opening 19 is elongated, while the lower outlet portion 20 thereof is of the same cross-section as second flow-through opening 18. Similarly, flow-through opening 21 in spout 15 is of the same cross-section as lower outlet portion 20 and as second flow-through opening 18. An inclined surface 22 connects lower outlet portion 20 with the elongated or oblong upper inlet portion of the third flow-through opening. By this arrangement it is again possible to ensure that all portions of any liquid melt within second flow-through opening 18 in slide plate 8 during movement of the slide plate to the closed position are positively drained into the flow-through opening through the lower stationary plate. However, in this embodiment of the invention it is possible to employ conventional or commercially available spouts 15 having flow-through openings 21 of conventional construction.

Figure 3:
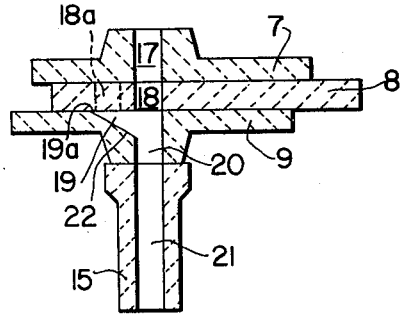
FIG. 3 is a simplified cross-section of another embodiment of the three-plate slide valve closure of the present invention.

The embodiment of FIG. 3 illustrates an additional feature of the present invention which may also be employed in the embodiment of FIG. 1. Specifically, upper end edge 19*a* of the third flow-through opening 19, i.e. the leftmost edge as shown in FIG. 3, is positioned to lie outwardly of the area covered by the second flow-through opening 18 during movement of the slide plate 8. Thus, upper end edge 19*a* is spaced outwardly from the second flow-through opening 18 in all positions of the slide plate, and specifically when the slide plate is in the closed position. Therefore, when the slide plate is in the closed position the second flow-through opening 18*a* (shown in dashed lines in FIG. 3) will be spaced inwardly from edge 19*a*, and therefore no possibility of any liquid melt contacting and catching on edge 19*a* occurs.

Although the present invention has been described and illustrated with respect to specific preferred structural features thereof, it is to be understood that various modifications may be made without departing from the scope of the present invention.

What we claim is:

1. In a three-plate slide valve closure for liquid melt containers such as steel ladles, said closure being of the type including an upper stationary apertured refractory plate adapted to be fixedly positioned beneath an outlet in a liquid melt container, a lower stationary apertured refractory plate adapted to be fixedly positioned at a location spaced from said upper stationary plate, an apertured refractory slide plate mounted between said upper and lower stationary plates for sliding movement between open and closed positions, and said upper stationary plate, said slide plate and said lower stationary plate having extending therethrough first, second and third flow-through openings, respectively, which are aligned when said slide plate is in said open position, the improvement wherein:

at least an inlet portion of said third flow-through opening, adjacent said slide plate, has a dimension in the direction of movement of said slide plate at least twice as great as the dimension of an outlet end of said second flow-through opening in said direction, such that said outlet end of said second flow-through opening is constantly in communication with said third flow-through opening during movement of said slide plate between said open and closed positions, and no portion of an upper inlet edge of said third flow-through opening is ever positioned inwardly of any portion of a lower outlet edge of said second flow-through opening at all positions of said slide plate.

2. The improvement claimed in claim 1, wherein said third flow-through opening includes an outlet portion, spaced from said slide plate, which has a dimension in said direction equal to said dimension of said second flow-through opening.

3. The improvement claimed in claim 1, wherein said third flow-through opening, throughout the entire length thereof, has said dimension at least twice as great as said second flow-through opening.

4. The improvement claimed in claim 1, further comprising a refractory outlet spout removably attached to said lower stationary plate, said spout having therethrough a fourth flow-through opening having a cross-section corresponding to the cross-section of an outlet portion of said third flow-through opening.

5. The improvement claimed in claim 1, wherein said third flow-through opening includes an upper end edge which lies outwardly of the area covered by said second flow-through opening during movement of said slide plate, such that said upper end edge is spaced from said second flow-through opening when said slide plate is in said closed position.

6. The improvment claimed in claim 1, wherein said second flow-through opening has throughout the entire length thereof a constant dimension.

7. The improvement claimed in claim 1, wherein said second flow-through opening is cylindrical throughout the entire length thereof.

* * * * *